United States Patent [19]

Rao et al.

[11] Patent Number: 4,551,212

[45] Date of Patent: Nov. 5, 1985

[54] BATH AND PROCESS FOR THE ELECTRODEPOSITION OF MICROMACHINABLE COPPER AND ADDITIVE FOR SAID BATH

[75] Inventors: Srinivas T. Rao, Kendall Park; Louis Trager, Raritan, both of N.J.

[73] Assignee: RCA Corporation, Princeton, N.J.

[21] Appl. No.: 710,290

[22] Filed: Mar. 11, 1985

[51] Int. Cl.[4] ..... C25D 3/38

[52] U.S. Cl. ..... 204/52 R; 204/DIG. 2

[58] Field of Search ..... 204/52 R, 44, DIG. 2, 204/106, 123

[56] References Cited

U.S. PATENT DOCUMENTS

| | | | |
|---|---|---|---|
| 2,424,887 | 7/1947 | Hendricks | 204/52 |
| 2,707,166 | 4/1955 | Brown et al. | 204/52 |
| 3,267,010 | 8/1966 | Creutz et al. | 204/52 |

*Primary Examiner*—G. L. Kaplan

*Attorney, Agent, or Firm*—Birgit E. Morris; Edward J. Sites

[57] ABSTRACT

It has been found that an additive comprising a mixture of phenazine dyestuffs in the combination from about 30 to 40 percent by weight of (a) a Janus Green B type dyestuff or a mixture thereof and (b) from about 70 to 60 percent by weight of Safranine T, when added to an aqueous acidic copper sulfate bath in the amount of about 0.03 to about 0.10 gram per liter of the bath, deposits copper consistently with the required properties for micromachining.

13 Claims, No Drawings

BATH AND PROCESS FOR THE ELECTRODEPOSITION OF MICROMACHINABLE COPPER AND ADDITIVE FOR SAID BATH

This invention relates to the electrodeposition of copper and more particularly is concerned with an additive employed in the electrodeposition bath to impart micromachinability to the electrodeposited copper.

BACKGROUND OF THE INVENTION

The electrodeposition of copper is used extensively in a variety of industrial processes including electroplating and electroforming. The many and varied uses for electrodeposited copper generally require somewhat different combinations of physical properties, such as electrical conductivity, hardness, ductility, film forming properties, adhesion to other materials, brightness and the like. In addition to having the specific properties noted above, electrodeposited copper, in general, should likewise be relatively easy to machine into precise configurations.

Special electrodeposition baths have been developed for the electrodeposition of copper used for different types of applications. The typical electrodeposition baths are primarily comprised of aqueous acidic solutions of copper sulfate. Selected additives are typically added to the electrodeposition bath to vary properties of the copper for a given application. Usually a combination of additives is employed, with each additive being included in the electrodeposition bath for a particular purpose. Conventional additives include materials such as thiourea, dextrin, molasses and the like to control the electrodeposition process. Aliphatic and aromatic quaternary amines can be added to improve the brightness of the electrodeposited copper. Polysulfides are also commonly used as additives to improve the ductility of the electrodeposited copper.

More recently, dyes of the phenazine class and, more specifically, the phenazine azo dyes, have been extensively employed to improve the leveling properties of electrodeposition baths and to improve the brightness and mechanical properties, such as ductility, of the electrodeposited copper.

The members of the phenazine class of dyestuffs which have proven to be most useful are represented by the formula

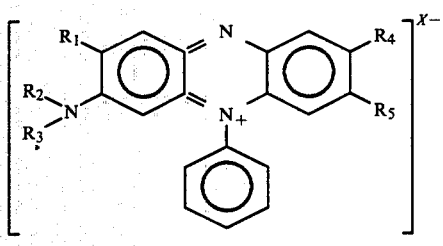

wherein $R_1$ to $R_4$ are the same or different and can be hydrogen, methyl, or ethyl and $R_5$ can be hydrogen, $—NH_2$, $—N(CH_3)_2$ and —N=N—Z where Z is an aromatic coupling group selected from the group consisting of phenyl, naphthyl or phenyl and naphthyl radicals substituted with amino, alkyl, substituted alkyl, hydroxy and alkoxy substituents, and X is an anion selected from the group consisting of $Cl^-$, $Br^-$, $SO_4^{--}$ and $HSO_4^-$.

Among the above dyestuffs of the phenazine class, the phenazine azo dyestuffs are the most effective members of the class to improve the brightness and other related properties of electrodeposited copper, in particular, the Janus Green B type dyestuffs.

The phenazine class of additives and, in particular, those additives comprised of Janus Green B type dyestuffs, have wide commercial acceptance for use in the electrodeposition of copper for conventional applications. The resulting deposited copper is bright and can readily be machined and finished using conventional machining tools and methods within generally acceptable tolerances required for relatively large scale articles.

Recently, however, there have been a number of applications which require copper substrates and the like which must be precisely machined with features which are 10 to 100 times smaller in size than the features obtainable using conventional machine tools and machining techniques. These new applications include, for example, recording substrates for high density information discs, such as optical discs, compact audio discs, capacitance electronic discs and the like, which typically have information tracks which are 0.5 micrometer in depth with information tracks being spaced at about 4000 tracks per centimeter. In order to be used for micromachining, a copper substrate must have proper grain size and hardness. Satisfactory electrodeposited copper for micromachining has a grain size from about 200 to about 500 Angstroms and a hardness of from about 250 to about 320 on the Knoop hardness scale measured at 15 grams. In addition, copper substrates having the above-noted properties and which are also bright and have fine laminar structures exhibit excellent micromachinability. The ultimate test, however, is that the electrodeposited copper must exhibit excellent diamond turnability when micromachined.

Another problem that has become apparent is that the electrodeposition baths have batch to batch variations which adversely affect the deposited copper properties. Micromachining problems are encountered with electrodeposited copper made with different additives and using the same additives under apparently identical operating conditions. As a result of trial and error, it has been found the electrodeposition bath which contained, as an additive, a Janus Green B type dyestuff generally provides a higher proportion of satisfactory copper parts for micromachining. However, even using the Janus Green B type dyestuff as an electrodeposition additive, the electrodeposited copper which is obtained varies widely in properties from batch to batch and even with electrodeposited copper parts made in the same electrodeposition bath but at different times in the production cycle.

In order to determine if impurities were causing the problems, chemically pure samples of Janus Green B type dyestuffs were evaluated as additives, but unexpectedly even more erratic and unsatisfactory results were obtained. Mixtures of different Janus Green B type dyestuffs were also evaluated with no better success than that obtained with a single type of Janus Green B type dyestuff.

The problems that were encountered were, among other things, that the electrodeposited copper was either too soft or too hard for micromachining. In the micromachining process, electrodeposited copper that is too hard will not machine properly and expensive, delicate tools are often broken in the micromachining process. Electrodeposited copper which is too soft micromachines unevenly and tends to be easily gouged and burrs frequently are formed on the machined surfaces.

What would be highly desirable would be an electrodeposition bath additive, an electrodeposition bath composition, and a process for electrodepositing copper which would consistently result in micromachinable electrodeposited copper.

SUMMARY OF THE INVENTION

It has been found that an additive comprised of a mixture of phenazine dyestuffs in the combination from about 30 to 40 percent by weight of (a) a Janus Green B type dyestuff or a mixture thereof and (b) from about 70 to 60 percent by weight of Safranine T, when added to an aqueous acidic copper sulfate bath in an amount of about 0.03 to about 0.10 gram per liter of the bath, induces copper to be consistently electrodeposited with the required properties for micromachining.

DETAILED DESCRIPTION OF THE INVENTION

The term micromachinability, as employed herein, means the ability of an electrodeposited copper to be accurately machinable, to dimensions of 5 micrometers or less, using mechanical means. The degree of accuracy required will vary depending on the intended end use, but typically should be less than a total deviation of ±10% and preferably less than ±5%.

Good micromachinability is clearly indicated by production of a relatively continuous chip during machining, that is, the machined-off material is removed in a continuous strip as opposed to a series of short strips or chips.

It was found that electrodeposited copper having the properties required for micromachining can be consistently obtained by using, in the electrodeposition bath, an additive comprised of a specific combination of safranine class dyestuffs. More specifically, it was found that excellent micromachinability is obtained with an additive which is a mixture comprised of (a) about 30 to about 40 percent by weight of one or more Janus Green B type dyestuffs of the formula

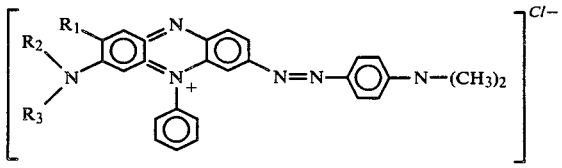

wherein $R_1$ is hydrogen or methyl, and $R_2$ and $R_3$ are methyl or ethyl and (b) from about 70 to about 60 percent by weight of Safranine T of the formula

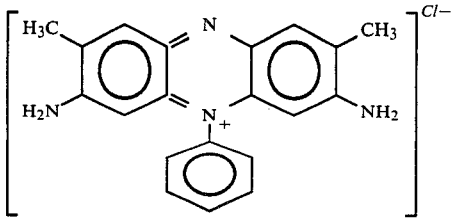

As a result of testing various mixtures, it was found that the optimum result, with regard to grain size and hardness of the deposited copper, is obtained with a mixture comprised of about 36 percent by weight of a Janus Green B type dyestuff or mixture thereof and about 64 percent by weight of Safranine T.

The Janus Green B type dyestuff represented by the formula can be chemical pure or can be of the industrial grade commonly obtainable from various commercial sources. The suitable Janus Green B type dyestuffs include, for example, Janus Green B (Diethyl Safranine Azo Aniline CI. 11045), Janus Green B (Dimethyl Safranine Azo Aniline CI. 11050) and Janus Black R.

The Safranine T is specific to this application as the other dyestuffs of similar chemical structures are not effective in combination with the Janus Green B type dyestuff to produce micromachinable electrodeposited copper. Safranine T is commercially available and is sold under various designations including CI. Basic Red 2.

Dyestuffs from each of the classes which comprise the additive of this invention have heretofore been suggested as an additive for use in the electrodeposition of copper. However, the individual dyestuffs of the mixture, that is, the Janus Green B type dyestuff and the Safranine T, when used by themselves, do not produce the consistent satisfactory results obtained with the mixture of dyestuffs. While the exact reason for this unexpected result is not known for certain, and patentability is not based on the reasons the excellent results are obtained, it is believed the unexpected results are due in part to use of a combination of dyestuffs of similar general structure, one of which, however, the Janus Green B type dyestuff, is diazotized and coupled and the other dyestuff, Safranine T, which is not diazotized and coupled.

The combination additive of this invention is used with an aqueous acidic solution of copper sulfate. The exact composition of the copper sulfate bath is not critical but it has been found that optimum results are obtained with a bath made of from about 200 to about 250 grams per liter of copper sulfate and from about 120 to about 140 grams per liter of sulfuric acid. In addition, it has been found preferable to further include in the electrodeposition bath from about 40 to 60 parts per million of chloride added in the form of hydrochloric acid.

The amount of the additive of this invention added to the electrodeposition bath is an amount which is sufficient to cause the electrodeposited copper to have a grain size of from about 200 to 500 Angstroms and a hardness of from about 250 to about 320 on the Knoop hardness scale measured at 15 grams. The amount of the additive of this invention added to the bath in order to obtain micromachinability under normal conditions employed in the electrodeposition of copper is between from about 0.03 and 0.10 gram per liter of the electrodeposition bath, with optimum results being obtained with about 0.065 gram of additive per liter of the electrodeposition bath.

In addition to the additive of this invention, other conventional additives are advantageously included in the electrodeposition bath. These additional additives include wetting agents in an amount to insure an adequate reduction in surface tension to insure satisfactory electrodeposition of the copper. Stress relieving agents are also advantageously added, particularly when electrodepositing copper on a dissimilar substrate to reduce the stress formed between the deposited copper and the substrate.

In use, the additive of this invention is preferably initially made up in a concentrated solution prior to addition to the electrodeposition bath. This can conventionally be done by dissolving the dyestuffs in an aqueous acidic solution. Any additional additives, such as the wetting agent and stress relieving agent, can be conveniently incorporated in the solution. A typical concentrated solution is comprised of, for example:

| | |
|---|---|
| Janus Green B | 1.152 gm |
| Safranine T | 2.048 gm |
| $H_2SO_4$ | 75.0 ml |
| Pluracol P710 (wetting agent) | 10.5 gm |
| Bis (3-sulfopropyl disulfide disodium salt (0.5 m) (stress relieving agent) | |
| and water to bring the total volume of the solution to one liter | 19.2 ml |

The concentrated solution of the additive of this invention is preferably added on a continuous basis to the electrodeposition bath during electrodeposition to maintain the concentration of the additive within the specified range. Continuous addition of the additive is preferred because the additive of the invention is gradually depleted from the bath during electrodeposition and the additive level should be maintained relatively constant in order to obtain consistent results from part to part.

The additive of this invention, comprised of the combination of Janus Green B (CI. 11045) and Safranine T, was evaluated using the same electrodeposition parameters as those employed when Janus Green B (CI. 11045) alone was used. The electrodeposition bath was electrolyzed which caused deposition of copper. It was surprisingly found that under identical electrodeposition conditions, erratic, uncontrollable results were obtained using only Janus Green B (CI. 11045) as the additive. However, the additive of this invention, comprising Janus Green B (CI. 11045) and Safranine T, resulted in consistently satisfactory electrodeposited copper being deposited having a grain size in the specific range of 200 to 500 Angstroms and a hardness of about 250 to about 320 on the Knoop hardness measured at 15 grams. All the copper samples produced using the additive of this invention were found to have excellent micromachinability when turned with a diamond cutting tool.

What is claimed is:

1. An additive for use in an electrodeposition bath comprised of an aqueous acidic solution of copper sulfate, said additive being comprised of a mixture of phenazine dyestuffs in the combination of:

(a) from about 30 to about 40 percent by weight of one or more Janus Green B type dyestuffs of the formula

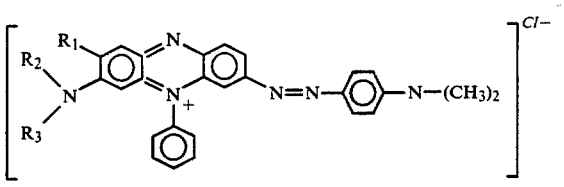

wherein $R_1$ is hydrogen or methyl, and $R_2$ and $R_3$ are the same or different and are methyl or ethyl; and (b) from about 70 to about 60 percent by weight of Safranine T of the formula

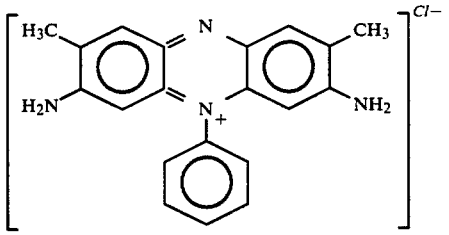

2. The additive according to claim 1 wherein the mixture is comprised of about 36 percent by weight of a Janus Green B type dyestuff or mixture thereof and about 64 percent by weight of Safranine T.

3. A bath for electrodepositing copper comprising an aqueous acidic solution of copper sulfate having dissolved therein an additive comprised of a mixture of phenazine class dyestuffs in the combination of:

(a) from about 30 to about 40 percent by weight of one or more Janus Green B type dyestuffs of the formula

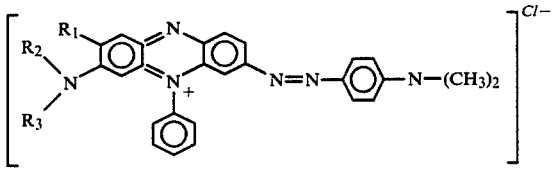

wherein $R_1$ is hydrogen or methyl, $R_2$ and $R_3$ are the same or different and are methyl or ethyl; and (b) from about 70 to about 60 percent by weight of Safranine T represented by the formula

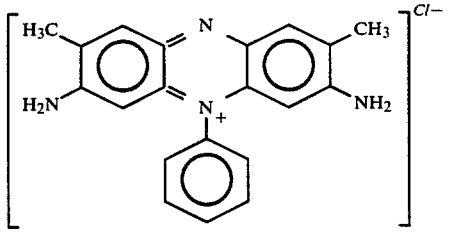

in an amount sufficient to cause said copper to have a grain size of about 200 to about 500 Angstroms and a hardness of about 250 to about 320 on the Knoop hardness scale.

4. The bath according to claim 3 wherein said mixture is comprised of about 36 percent by weight of a Janus Green B type dyestuff or mixture thereof and about 64 percent by weight of Saffranine T.

5. The bath according to claim 3 wherein said bath contains from about 0.03 to about 0.10 gram per liter of said mixture.

6. The bath according to claim 3 wherein said bath contains about 0.065 grams per liter of said mixture.

7. The bath according to claim 3 wherein said bath contains from about 200 to about 250 grams per liter of copper sulfate and from about 120 to about 140 grams per liter of sulfuric acid.

8. The bath according to claim 7 which further contains from about 40 to about 60 parts per million of chloride ions.

9. The bath according to claim 3 which further contains an effective amount of a wetting agent.

10. The bath according to claim 3 which further contains an effective amount of a stress relieving agent.

11. In a process for electrodepositing micromachinable copper by electrolyzing an aqueous acidic bath comprised of copper sulfate, the improvement which comprises adding to said bath an effective amount of a mixture of phenazine dyestuffs in the combination of:

(a) from about 30 to about 40 percent by weight of one or more Janus Green B type dyestuffs of the formula

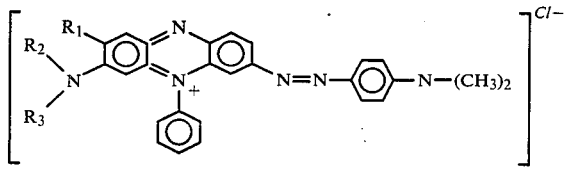

wherein $R_1$ is hydrogen or methyl, and $R_2$ and $R_3$ are the same or different and are methyl or ethyl; and (b) from about 70 to about 60 percent by weight of Safranine T of the formula

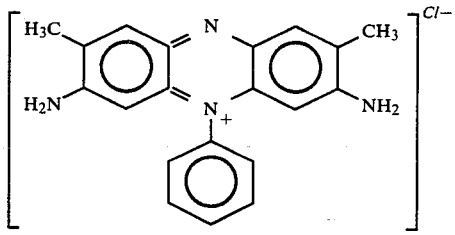

said amount effective to cause said copper as electrodeposited to have a grain size of about 200 to about 500 Angstroms and a hardness of about 250 to about 320 on the Knoop hardness scale.

12. The process according to claim 11 wherein said bath contains from about 0.03 to about 0.10 gram per liter of said mixture.

13. The process according to claim 11 wherein said bath contains about 0.065 gram per liter of said mixture.

* * * * *